US012115418B2

(12) United States Patent
Lin

(10) Patent No.: US 12,115,418 B2
(45) Date of Patent: Oct. 15, 2024

(54) MOTOR RESISTANCE CONTROL STRUCTURE FOR AN EXERCISING APPARATUS

(71) Applicant: Chih-Yung Hsu, Tainan (TW)

(72) Inventor: Tsung-Chou Lin, Tainan (TW)

(73) Assignee: Chih-Yung Hsu, Tainan (TW)

( * ) Notice: Subject to any disclaimer, the term of this patent is extended or adjusted under 35 U.S.C. 154(b) by 244 days.

(21) Appl. No.: 17/961,342

(22) Filed: Oct. 6, 2022

(65) Prior Publication Data

US 2023/0166158 A1 Jun. 1, 2023

(30) Foreign Application Priority Data

Nov. 29, 2021 (TW) ..... 110214170

(51) Int. Cl.
*A63B 24/00* (2006.01)
*A63B 21/005* (2006.01)

(52) U.S. Cl.
CPC ..... *A63B 24/0087* (2013.01); *A63B 21/0058* (2013.01); *A63B 2220/51* (2013.01)

(58) Field of Classification Search
CPC ..... A63B 24/0087; A63B 21/0058; A63B 2220/51; A63B 71/0054; A63B 21/0783; A63B 21/4035; A63B 23/03525; A63B 2022/0079; A63B 2024/0093; A63B 2071/0072; A63B 2071/0081; A63B 21/4043
See application file for complete search history.

(56) References Cited

U.S. PATENT DOCUMENTS 5,304,104 A * 4/1994 Chi ..... A63B 21/153 482/99
2012/0053014 A1* 3/2012 Zhu ..... A63B 21/4035 482/5

* cited by examiner

*Primary Examiner* — Mohamad A Musleh
(74) *Attorney, Agent, or Firm* — Muncy, Geissler, Olds & Lowe, P.C.

(57) ABSTRACT

A motor resistance control structure for an exercising apparatus comprises a motor, a drawing member, a control unit, and a sensing element. The control unit controls the motor to generate a resistance and outputs a first instruction to allow an output shaft to rotate by a first present revolution along a first sense of rotation. The drawing member receives an applied force and pulls the output shaft to rotate by a training revolution along the first sense of rotation. The sensing element senses the applied force and gets a sensing result. By the comparison of the applied force with the resistance, the control unit controls the output shaft to rotate by a second preset revolution along a second sense of rotation or release the resistance of the motor, which avoids a problem in an ordinary exercising apparatus that a counterweight may fall freely to injure a user.

11 Claims, 7 Drawing Sheets

MOTOR RESISTANCE CONTROL STRUCTURE FOR AN EXERCISING APPARATUS

BACKGROUND OF THE INVENTION

(a) Field of the Invention

The present invention relates to an exercising apparatus, and more particularly to a motor resistance structure for the exercising apparatus that the motor resistance can be changed or constant.

(b) Description of the Prior Art

Referring to FIG. 7, many exercising apparatuses (not shown in the drawing) will be provided with a counterweight 1', allowing a user to pull a handle grip 2' which enables a drawing member 3' to drive the counterweight 1' to move up and down, thereby achieving the effect of weight training.

The weight of the ordinary counterweight 1' can be adjusted by increasing or decreasing the number of counterweight 1' or by using a latch, which facilitates the user to select a proper weight for training according to his or her need.

However, when the user operates the exercising apparatus for a period of time and feels fatigue, once an applied force of the user is not sufficient to maintain the counterweight 1' at a certain height and the user is too late to release the handle grip 2', speed of free fall of the counterweight 1' will cause the user's body to tilt rapidly toward direction of movement A' of the counterweight 1', and even result in a muscle strain to the user. In addition, as the weight of the counterweight 1' is constant, the resistance can be only at a constant mode in the operation process.

SUMMARY OF THE INVENTION

Accordingly, a motor resistance structure for an exercising apparatus is provided, comprising a motor which is disposed in the exercising apparatus and includes an output shaft which is fixed with a turning wheel; a drawing member which wraps around the turning wheel; a control unit which is connected electrically with the motor; and a sensing element which connects a signal to the control unit. The control unit controls the motor to generate a resistance, and outputs a first instruction. The first instruction allows the output shaft to rotate by a first preset revolution along a first sense of rotation which overcomes a sense of rotation of the resistance. The drawing member receives an applied force and pulls the output shaft by the turning wheel to rotate by a training revolution along the first sense of rotation. The sensing element senses the applied force and gets a sensing result which is transmitted to the control unit. If the output shaft rotates along the first sense of rotation, the applied force is larger than the resistance, and the training revolution is larger than or equal to the first preset revolution, then the control unit will output a second instruction immediately or after a preset time. The second instruction controls the output shaft to rotate by a second preset revolution along a second sense of rotation which is opposite to the first sense of rotation. On the other hand, if the output shaft rotates along the first sense of rotation, the applied force is not larger than the resistance, and the training revolution is smaller than the first preset revolution, then the control unit will output a third instruction to release the resistance of the motor.

When the third instruction releases the resistance of the motor, the control unit controls the output shaft to stop rotating.

When the third instruction releases the resistance of the motor, the control unit controls the output shaft to rotate along the second sense of rotation.

When the output shaft rotates along the second sense of rotation, the control unit controls the output shaft to rotate uniformly.

When the output shaft rotates along the second sense of rotation, the control unit controls the output shaft to rotate non-uniformly.

When the output shaft rotates along the second sense of rotation, the control unit controls the output shaft to rotate in a fast-to-slow mode.

If the output shaft rotates along the first sense of rotation, the applied force is not larger than the resistance, and the training revolution is not smaller than the first preset revolution, then the control unit outputs the third instruction.

In the process that the output shaft rotates along the first sense of rotation as described above, the resistance is changeable and the rotation process includes at least a first stage and a second stage, wherein the resistance in the first stage is not the same as the resistance in the second stage.

In the process that the output shaft rotates along the second sense of rotation as described above, the resistance is changeable and the rotation process includes at least a third stage and a fourth stage, wherein the resistance in the third stage is not the same as the resistance in the fourth stage.

The following effects can be achieved preferably according to the abovementioned technical features:

1. When using the motor to control the resistance, the resistance can be changed or constant, and the changeable resistance cannot be achieved for the conventional counterweight.
2. The changeable resistance enables the user to set up a mode of changing the resistance from nothing to something, changing the resistance from small to large, changing the resistance from large to small, or changing the large and small resistance alternatively, which applies to the users at all ages.
3. When using the motor to control the resistance, there is no need to use the counterweight, and if the user feels tired during operation, the control unit can release the resistance of the motor. Therefore, there is no issue that the counterweight free falls, and the user can relax directly without worrying about the muscle strain.
4. When the user operates the output shaft to rotate by the training revolution along the first sense of rotation, the control unit can control the output shaft to rotate by the second preset revolution along the second sense of rotation, which retracts the drawing member and facilitates the user to proceed with a next operation.
5. When releasing the resistance, the output shaft is simply controlled to stop rotating, and the control unit can control the output shaft to rotate along the second sense of rotation to roll back and retract the drawing member directly.
6. When the output shaft rotates along the second sense of rotation, it can rotate uniformly or non-uniformly, and for the non-uniform rotation, the output shaft can rotate in the fast-to-slow mode. In terms of hand movement, the user can retract arms rapidly when the handle grip is away from the user, and the user can stop the operation slowly when the handle grip is close to the user, which reduces causing injury to a joint and muscle of the hand.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
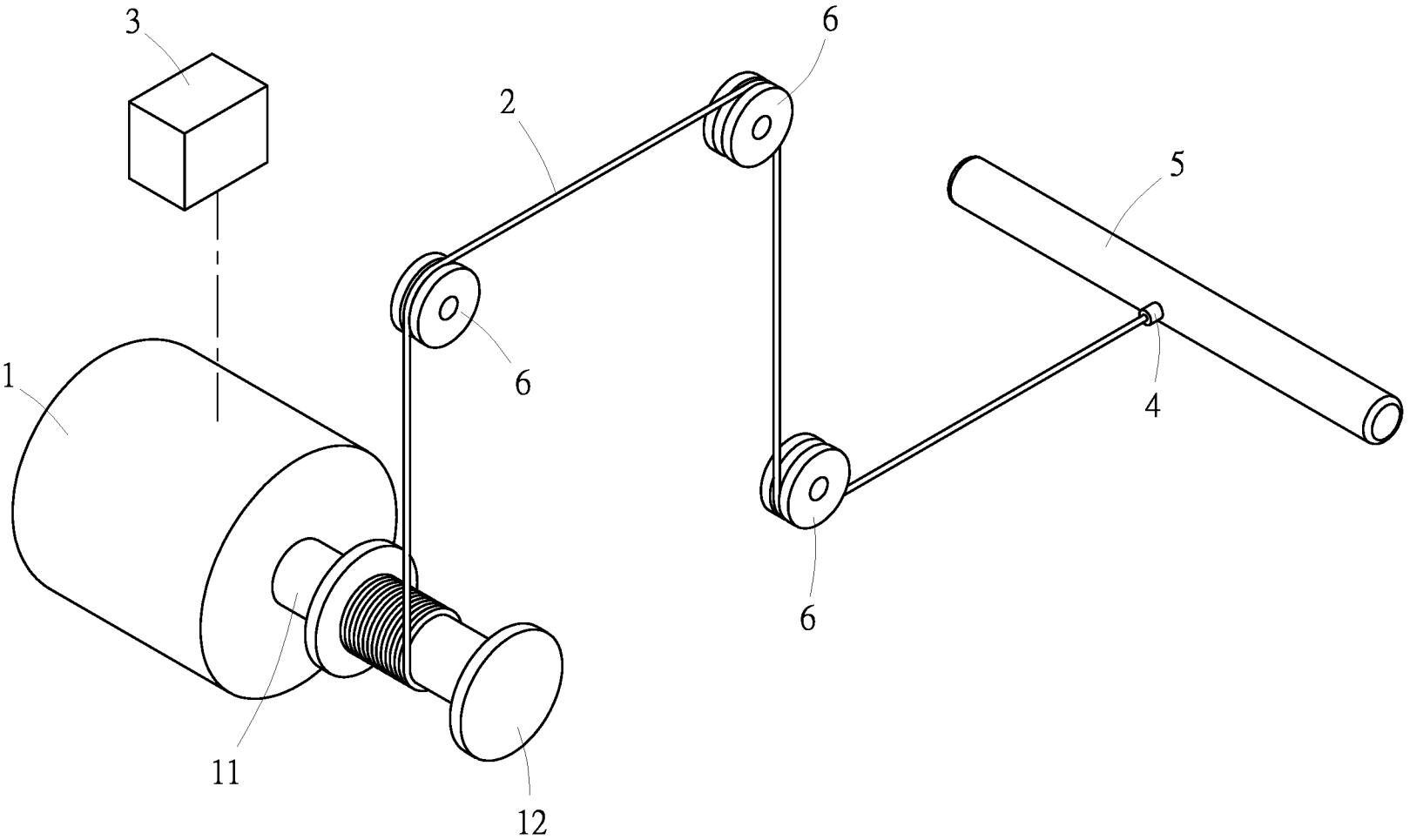
FIG. 1 shows a three-dimensional view of the present invention.
Figure 2:
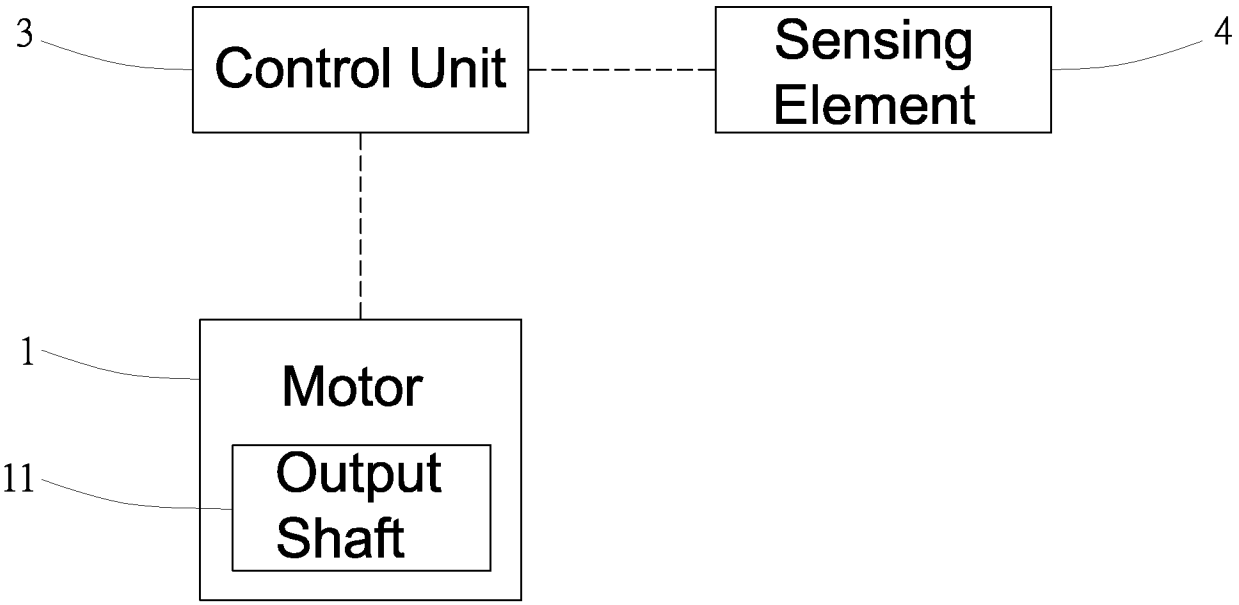
FIG. 2 shows a system block diagram of the present invention.

As shown in FIG. 1 and FIG. 2, the present invention discloses a motor resistance control structure for an exercising apparatus which is installed in the exercising apparatus (not shown in the drawings). The exercising apparatus can be any apparatus using the resistance to help exercising, such as, but not limited to, a rowing machine, a pulldown machine, a bench press, a raise machine or a chest expander.

The motor resistance control structure for an exercising apparatus comprises a motor 1, which is disposed in the exercising apparatus and includes an output shaft 11, with an end of the output shaft 11 being fixed with a turning wheel 12 allowing the output shaft 11 and the turning wheel 12 to rotate simultaneously; a drawing member 2 which wraps around the turning wheel 12 and can be, but not limited to, a steel cable or a rope; a control unit 3 which is connected electrically with the motor 1 and can be, but not limited to, a computer built into the exercising apparatus, an independent computer or a mobile device; and a sensing element 4 which connects a signal to the control unit 3 and can be a tensile force sensor installed on the drawing member 2 or a torque sensor installed on the output shaft 11, with the sensing element 4 in the present invention being the tensile force sensor disposed on an end of the drawing member 2 (no further description of the sensing element 4 is disclosed, as the principle of sensing element 4 is known in public).

To facilitate operation, an end of the drawing member 2 can be installed with a handle grip 5 for a user to hold. In addition, plural pulleys 6 can be installed on the exercising apparatus to guide the direction of drawing member 2 properly, which allows the user to operate conveniently.

Figure 3:
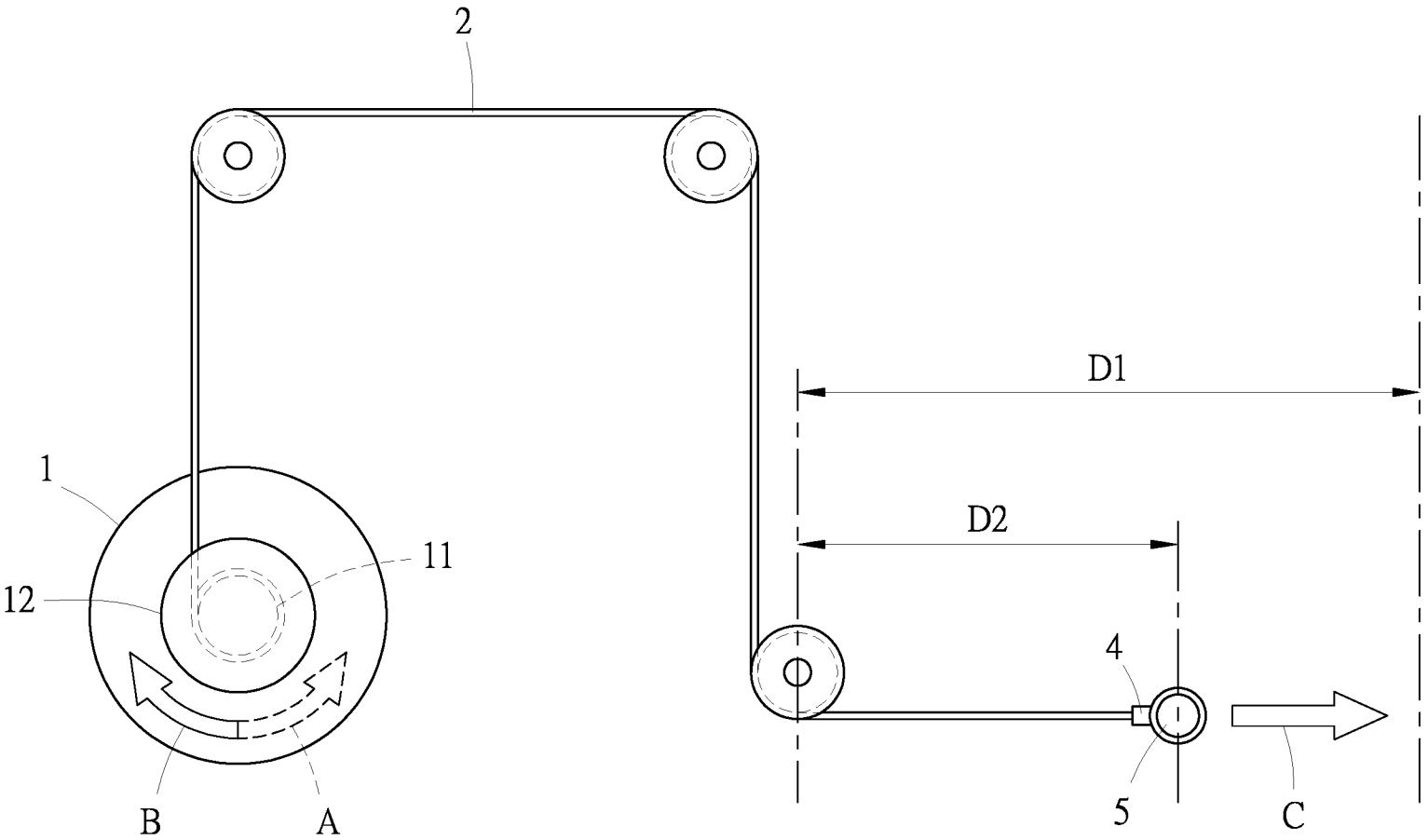
FIG. 3 is a first schematic view of implementation of the present invention, showing that a motor acts to release a drawing member.
Figure 4:
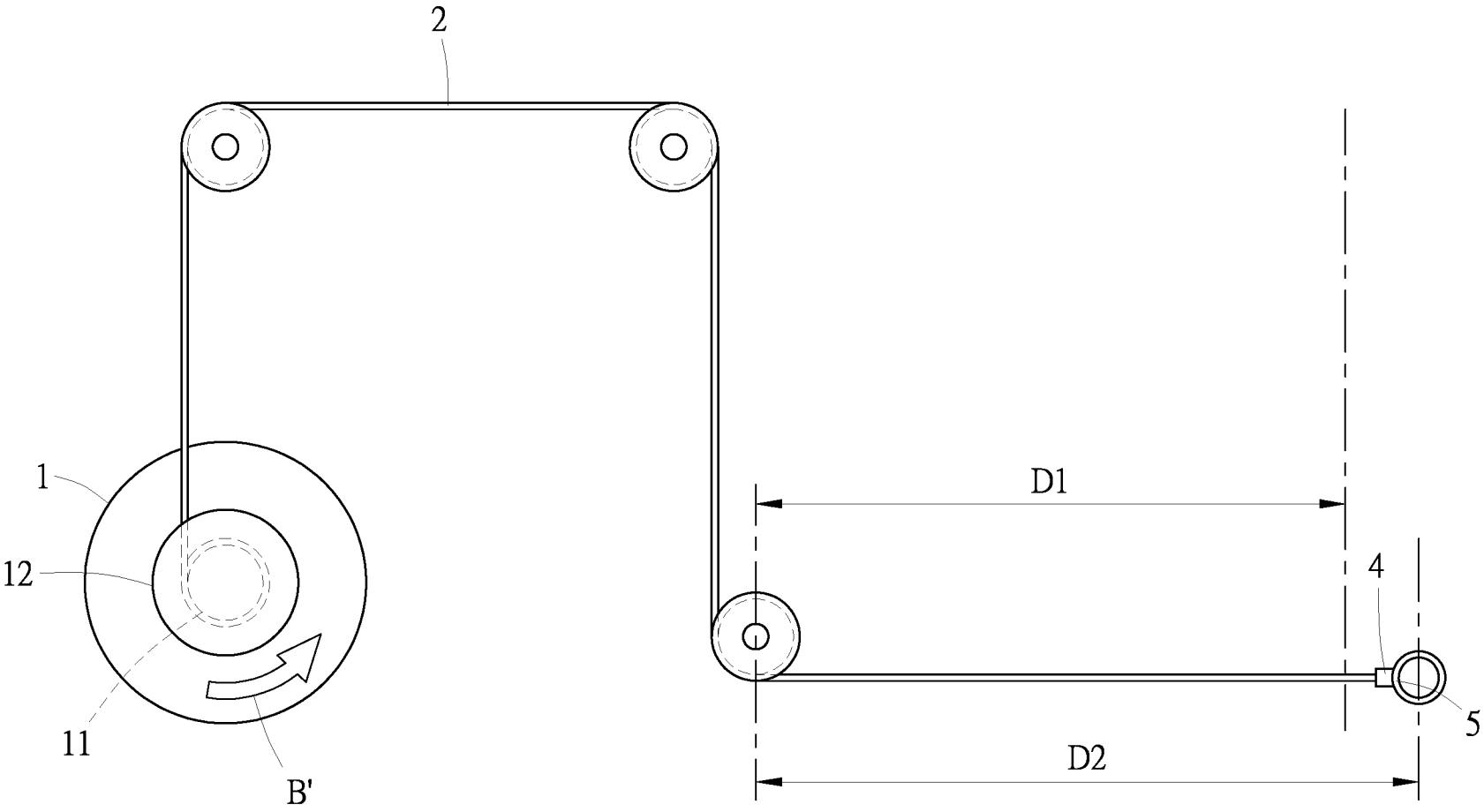
FIG. 4 is a second schematic view of implementation of the present invention, showing that the motor acts to retract the drawing member.

Referring to FIGS. 2 to 4, before the user starts to use the motor resistance structure for the exercising apparatus, the control unit 3 is activated first, such as turning on a switch or plugging into a power source.

After being activated, the control unit 3 will control the motor 1 to generate a resistance along a direction of resistance A and output a first instruction. The first instruction allows the output shaft 11 to rotate by a first preset revolution along a first sense of rotation B which overcomes a sense of rotation of the resistance. In the process that the output shaft 11 rotates along the first sense of rotation B, the resistance can be constant or changeable, wherein the changeable mode can be that the resistance changes from nothing to something, from small to large, from large to small or between large and small alternatively.

Preferably, the first sense of rotation B is the direction at which the drawing member 2 is released. The direction of resistance A is opposite to the first sense of rotation B and is the direction at which the drawing member 2 is retracted. Thus, when the output shaft 11 rotates along the first sense of rotation B, the resistance needs to be overcome. On the other hand, when the output shaft 11 rotates along the direction of resistance A (superimposing to a second sense of rotation B' as described below), there is no need to overcome the resistance.

Next, the user holds the handle grip 5 and applies a force to pull the handle grip 5. The applied force is provided with a direction of applied force C, enabling the handle grip 5 to drive the turning wheel 12 and the output shaft 11 via the drawing member 2, thereby allowing the output shaft 11 to rotate by a training revolution along the first sense of rotation B.

At this time, the sensing element 4 senses the applied force and gets a sensing result, e.g., the applied force is 50 kgf (kilogram-force), which is transmitted to the control unit 3.

If the output shaft 11 rotates along the first sense of rotation B, the applied force is larger than the resistance, and the training revolution is larger than or equal to the first preset revolution, e.g., the first preset revolution is 20 and the training revolution has reached 21, then the control unit 3 will output a second instruction immediately or after a preset time. If the control unit 3 outputs the second instruction immediately, then the second instruction controls the output shaft 11 to rotate by a second preset revolution along the second sense of rotation B', e.g., 21, allowing the drawing member 2 to be retracted, which facilitates the user to proceed with a next operation. On the other hand, if the control unit 3 outputs the second instruction after the preset time, e.g., 10 seconds, then the user can continue operation for 10 seconds under the applied force, so as to increase the intensity of training.

In the process that the output shaft 11 rotates along the first sense of rotation B, the rotation process includes at least a first stage and a second stage, and if the resistance is changeable, then the following modes are available:

- The resistance in the first stage is zero, and the resistance in the second stage is larger than zero.
- The resistances in the first and second stages are all larger than zero, and the resistance in the second stage is larger than that in the first stage.
- The resistances in the first and second stages are all larger than zero, and the resistance in the first stage is larger than that in the second stage.
- The resistances in the first and second stages can be changed immediately or changed after a specific time.

In the abovementioned retraction process, the control unit 3 can control the output shaft 11 to rotate uniformly or non-uniformly along the second sense of rotation B'. For the non-uniform rotation, the output shaft 11 can rotate in a fast-to-slow mode. In terms of a hand movement back to the exercising apparatus, when the handle grip 5 is away from the user, the user can retract the arms quickly; whereas, when the handle grip 5 is close to the user, the user can stop the operation slowly. Therefore, injury to a joint and muscle of the hand can be reduced and the operation can be more comfortable for preparation of a next operation. In practical implementation, the output shaft 11 can also rotate slowly and uniformly along the second sense of rotation B' or rotate in a slow-to-fast mode, depending upon the type of exercising apparatus and the user's need.

In another rotation process that the output shaft 11 rotates along the second sense of rotation B', at least a third stage and a fourth stage are included, wherein the resistance is changeable and can be provided with following modes:

The resistance in the third stage is zero, and the resistance in the fourth stage is larger than zero.

The resistances in the third and fourth stages are all larger than zero, and the resistance in the fourth stage is larger than that in the third stage.

The resistances in the third and fourth stages are all larger than zero, and the resistance in the third stage is larger than that in the fourth stage.

The resistances in the third and fourth stages can be changed immediately or changed after another specific time.

In the drawings, to manifest the first preset revolution and the training revolution, the distance corresponding to the first preset revolution is designated as a first distance D1, and the distance corresponding to the training revolution is designated as a second distance D2.

Figure 5:
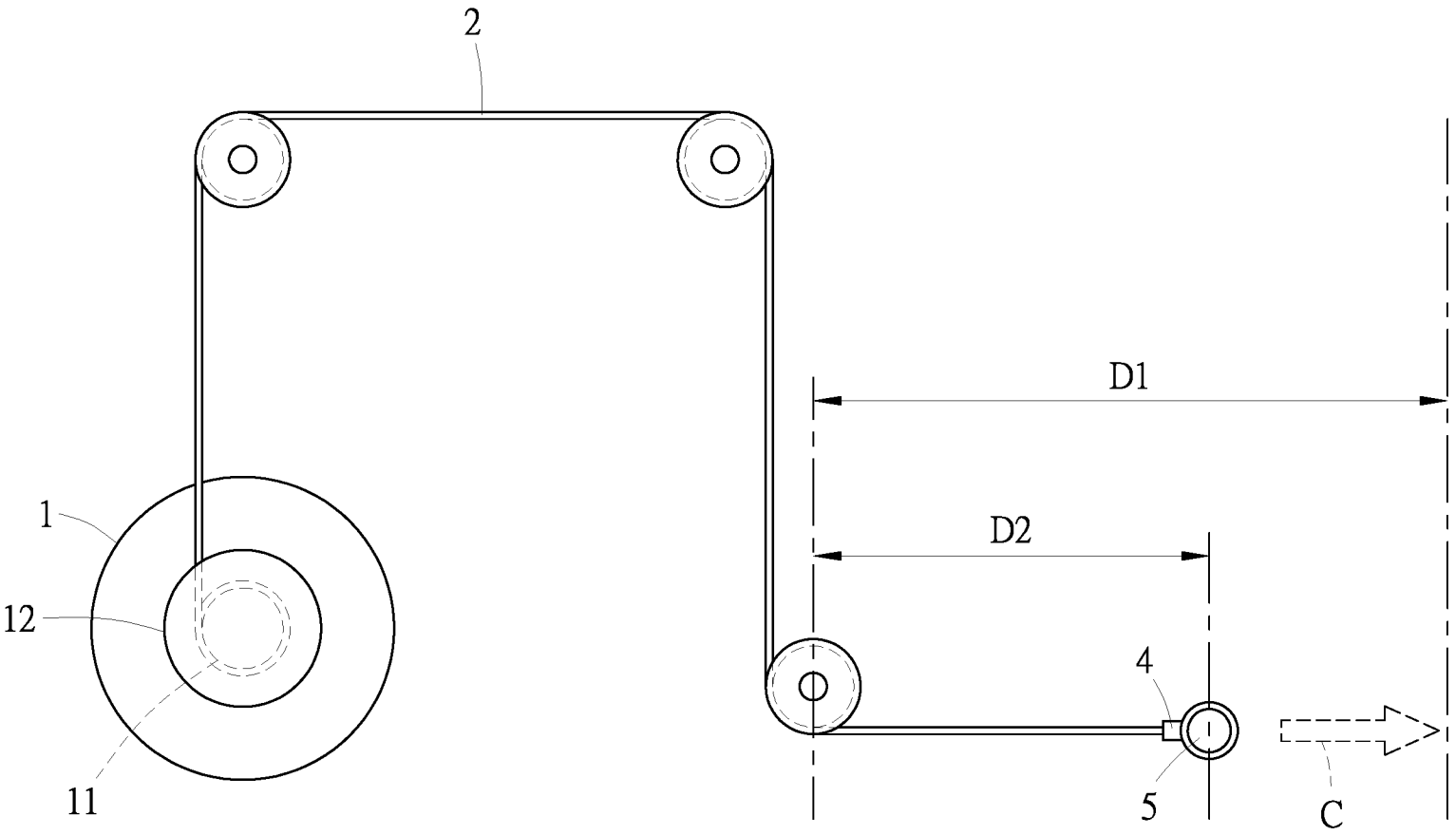
FIG. 5 is a third schematic view of implementation of the present invention, showing that the motor releases a resistance.

Referring to FIG. 2, FIG. 3 and FIG. 5, when the output shaft 11 rotates along the first sense of rotation B, if the applied force is not larger than the resistance and the training revolution is smaller than the first preset revolution, which usually happens when the user feels tired or wants to take a break during the operation, then the control unit 3 will output a third instruction to release the resistance of the motor 1 and control the output shaft 11 to stop rotating, allowing the user to relax completely without a need to overcome the resistance at that time.

Figure 6:
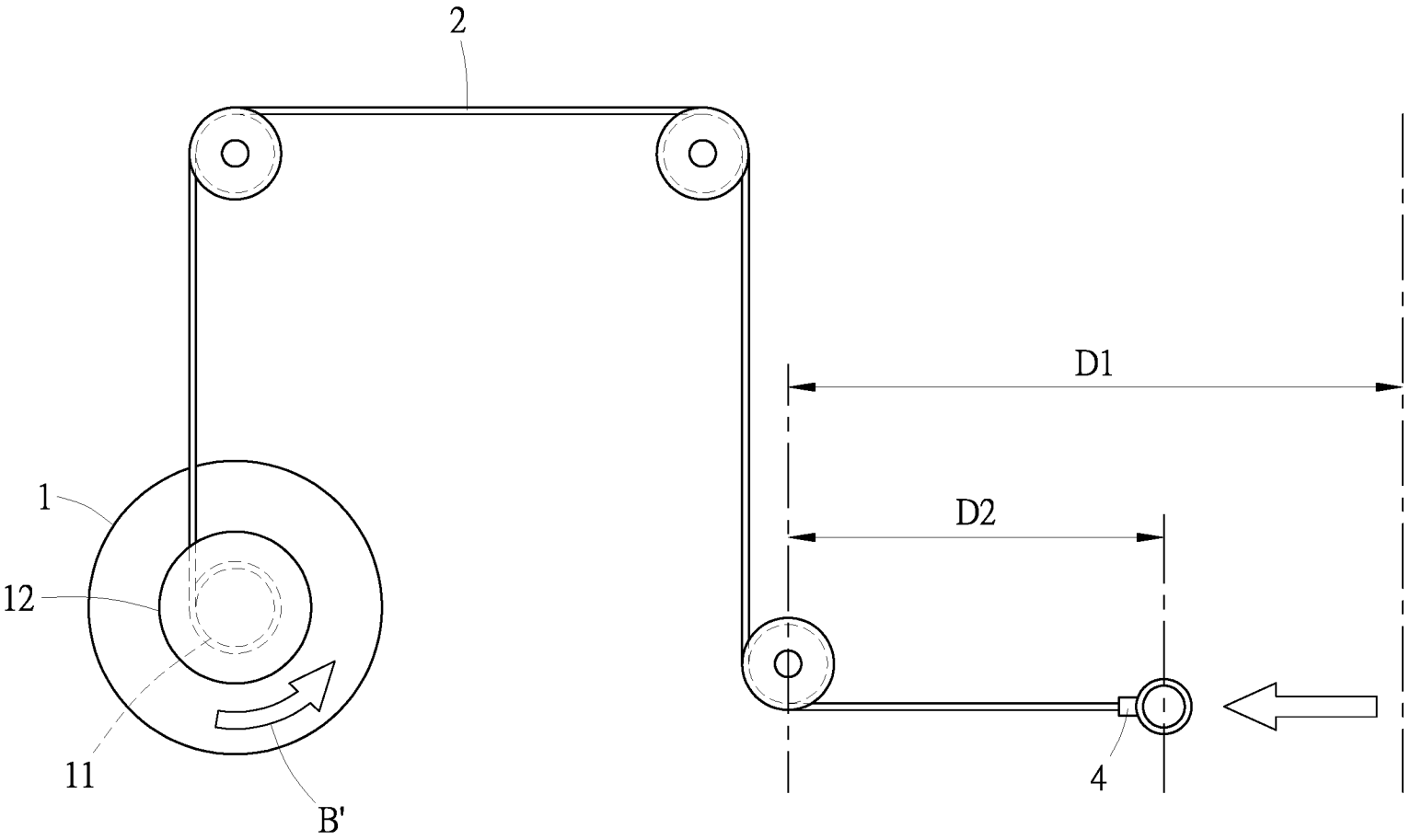
FIG. 6 is a fourth schematic view of implementation of the present invention, showing that the motor acts to retract the drawing member after releasing the resistance.
Figure 7:
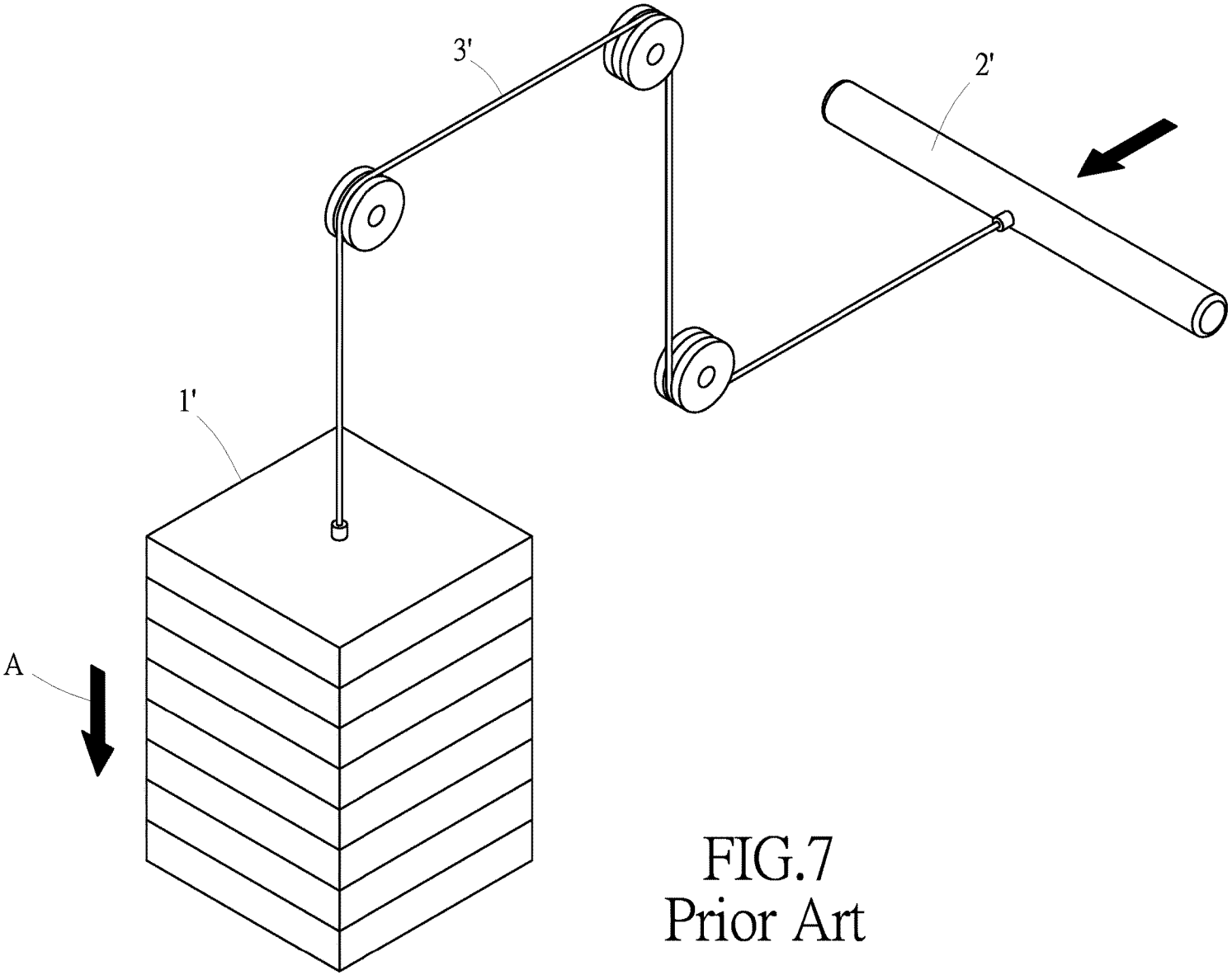
FIG.7 Prior Art
FIG. 7 shows a schematic view of implementation of a prior art.

Referring to FIG. 2 and FIG. 6, if the output shaft 11 stops rotating during the operation, then the control unit 3 can also stay at that condition for a period of time, waiting for the user to apply a force again to drive the output shaft 11 to continue rotating along the first sense of rotation B (please see FIG. 3 for the first sense of rotation B), so as to accomplish the given process. When the user applies a force again, the control unit 3 will continue executing the first instruction to control the motor 1 to restore the resistance. However, if the output shaft 11 stops rotating during the operation and if the user does not apply a force again in a certain period of time, then in addition to that the third instruction of the control unit 3 controls the output shaft 11 to stop rotating, the third instruction also further includes a retraction instruction to control the output shaft 11 to rotate along the second sense of rotation B', and roll back and retract the drawing member 2 directly, under the condition that the first preset revolution is not completed. At this time, the output shaft 11 still rotates along the second sense of rotation B' uniformly or non-uniformly.

Referring to FIG. 1 and FIG. 2 again, there is no need to use the counterweight upon using the motor 1 to control the resistance. When the user feels tired or wants to take a break during the operation, the control unit 3 can release the resistance of the motor 1 without causing the issue that the counterweight falls freely, so that the user can relax directly and does not need to worry about the muscle strain.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A motor resistance control structure for an exercising apparatus being installed in an exercising apparatus, comprising a motor, an output shaft, wherein, the output shaft being fixed with a turning wheel; a drawing member being wrapped around the turning wheel; a control unit being connected electrically to the motor; and a sensing element being connected with a signal to the control unit, thereby controlling the motor to generate a resistance, and outputting a first instruction, allowing the output shaft to rotate by a first preset revolution along a first sense of rotation, thus overcoming a sense of rotation of the resistance; the drawing member receiving an applied force to pull the output shaft to rotate by a training revolution along the first sense of rotation via the turning wheel; the sensing element sensing the applied force and having a sensing result obtained thereby transmitting to the control unit; under a condition when the output shaft rotating along the first sense of rotation, the applied force being larger than the resistance and the training revolution being larger than or equal to the first preset revolution, thereby enabling the control unit outputs the second instruction immediately or after a preset time controlling the output shaft to rotate by a second preset revolution along a second sense of rotation opposite to the first sense of rotation; and under a condition when the output shaft rotating along the first sense of rotation, the applied force being not larger than the resistance and the training revolution being smaller than the first preset revolution, thereby enabling the control unit outputting a third instruction to release the resistance of the motor.

2. The motor resistance control structure for an exercising apparatus, according to claim 1, wherein when the third instruction releasing the resistance of the motor, thereby enabling the control unit controlling the motor to stop rotating.

3. The motor resistance control structure for an exercising apparatus, according to claim 1, wherein when the third instruction releasing the resistance of the motor, thereby enabling the control unit controlling the output shaft to rotate along the second sense of rotation.

4. The motor resistance control structure for an exercising apparatus, according to claim 1, wherein when the output shaft rotating along the second sense of rotation, thereby enabling the controlling unit controls the output shaft to rotate uniformly.

5. The motor resistance control structure for an exercising apparatus, according to claim 1, wherein when the output shaft rotating along the second sense of rotation, thereby enabling the controlling unit controls the output shaft to rotate non-uniformly.

6. The motor resistance control structure for an exercising apparatus, according to claim 5, wherein when the output shaft rotating along the second sense of rotation, thereby enabling the control unit controlling the output shaft to rotate in a fast-to-slow mode.

7. The motor resistance control structure for an exercising apparatus, according to claim 1, wherein when the output shaft rotating along the first sense of rotation, the applied force being not larger than the resistance and the training revolution being not smaller than the first preset revolution, thereby enabling the control unit outputting the third instruction.

8. The motor resistance control structure for an exercising apparatus, according to claim 1, wherein in the process that the output shaft rotating along the first sense of rotation, the resistance being changeable.

9. The motor resistance control structure for an exercising apparatus, according to claim 8, wherein the rotation process including at least a first stage and a second stage, and the resistance in the first stage being not the same as that in the second stage.

10. The motor resistance control structure for an exercising apparatus, according to claim 1, wherein in the process that the output shaft rotating along the second sense of rotation, the resistance being changeable.

11. The motor resistance control structure for an exercising apparatus, according to claim 10, wherein the rotation process including at least a third stage and a fourth stage, and the resistance in the third stage being not the same as that in the fourth stage.

* * * * *